United States Patent [19]

Nelson

[11] 4,311,481

[45] Jan. 19, 1982

[54] METHOD FOR IMPROVED DYEING

[75] Inventor: Eric L. Nelson, Santa Ana, Calif.

[73] Assignee: Nelson Research & Development Company, Irvine, Calif.

[21] Appl. No.: 227,630

[22] Filed: Jan. 23, 1981

[51] Int. Cl.[3] ..... D06P 1/649

[52] U.S. Cl. ..... 8/564

[58] Field of Search ..... 8/564

[56] References Cited

U.S. PATENT DOCUMENTS

| | | | |
|---|---|---|---|
| 2,890,092 | 6/1959 | Mautner | 8/564 |
| 3,096,142 | 7/1963 | Hartmark et al. | 8/564 |
| 3,332,938 | 7/1967 | Mayhew et al. | 8/564 |
| 3,449,154 | 6/1969 | Katz | 8/564 |
| 3,486,838 | 12/1969 | Dayte et al. | 8/564 |
| 3,963,418 | 6/1976 | Tullio | 8/564 |
| 3,989,816 | 11/1976 | Rajadhyaksha | 424/88 |

FOREIGN PATENT DOCUMENTS 1553309 9/1979 United Kingdom .

*Primary Examiner*—Maria Parrish Tungol

*Attorney, Agent, or Firm*—Martin A. Voet

[57] ABSTRACT

There is disclosed a method of improvement of dyeing fibers by utilizing in the dyeing process, an effective, dye-enhancing amount of a textile auxiliary having the structural formula

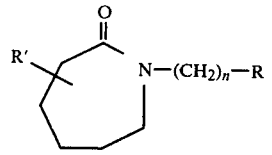

wherein R' is H or a lower alkyl group having 1–4 carbon atoms, n is O or a positive integer from 1–11 and R is an alkyl group (straight or branch chain) having 1–18 carbon atoms or aryl group, e.g., phenyl. The compounds disclosed herein enhance dye penetration of fibers and allow the dyeing process to take place at lower temperatures in less time.

3 Claims, No Drawings

METHOD FOR IMPROVED DYEING

BACKGROUND OF THE INVENTION

1. Field of the Invention

The invention generally relates to a method of improvement of dyeing. More particularly, the invention relates to an improved method of dyeing fibers through the use of a novel textile auxiliary.

2. Background of the Prior Art

Various kinds of machinery and chemicals used for the processes of scouring, bleaching, mercerising, milling, dyeing and finishing of textile materials are known. It has become possible in recent years to improve the efficiency of these processes by the use of special chemical assistants which are now marketed under the term textile auxiliaries. These assistants have now become essential and no dyer or finisher would think of processing textile materials without first considering whether or not it was possible to make the process more effective or to carry it out more expeditiously by the use of a selected textile auxiliary.

Soap is one of the best-known auxiliaries since it has been used for many years. In washing operations the presence of soap in the detergent liquor promotes the spread of the liquor in and between the fibers while it also assists the removal of dirt from the fibers and then holds the removed dirt in stable suspension in the liquor so that it cannot be reabsorbed by the cleaned fibers. Further, if a small amount of the soap is left in the washed textile material this can remain softer than it otherwise would have been. The soap thus assists the washing process in four distinct ways.

Soap has some disadvantages. For instance, it is precipitated as an objectionable scum when used in hard water and it is liable to after-yellow during the storage of soap-containing fabrics and garments. Following a search for soap substitutes free from the defects, but having all the usefulness of soap, there are today many synthetic alternatives to soap and a large proportion of them are made from petroleum products rather than natural fats and oils; they can be used in hard water and often have superior wetting and detergent properties.

Arising from this search for synthetic detergents has come the discovery of many types of textile auxiliaries having specialized uses, so that today a special section of the chemical industry is given over to their production. It is likely that the manufacture of textile auxiliaries is now as important as the manufacture of dyes. Today there are some thousands of individual products which can be classified according to their uses thus:

Wetting Agents—These are added to scouring, dyeing and other processing liquors to promote rapid penetration of the liquor among the fibers and so overcome the natural resistance to wetting which is shown by many textile materials. It is usual for the more complete wetting thus obtained to be accompanied by a more even wetting so that the processing is thus made much more satisfactory. Only selected wetting agents can be used in mercerising liquors for many are decomposed or precipitated by the high concentrations of alkali.

Detergents—These can often be used in hard water and sometimes even under acid conditions without losing their efficiency or forming a scum. They allow scouring operations to be carried out under conditions less harmful to the textile material. Most of them have good emulsifying power towards fats and waxes, combined with high wetting power, so that they are more efficient than soap in removing natural impurities from raw fibers or heavily soiled goods.

Softeners—Such products are today exceptionally useful to dyers and finishers, not only to give increased softness to ordinary articles but also to make soft those fabrics and garments which have been made harsher by the bleaching, dyeing or other treatments to which they have been subjected. Many of these softening agents (they can be regarded as fiber lubricants) are held by the textile fibers as tenaciously as dyes, so that the softening they produce is almost permanent. It is important not to use softeners which reduce the fastness of colored goods to light or washing.

Dye-Dispersing Agents—These substances are added to dye liquors, to printing pastes and to the liquors used for rinsing dyed materials. Their main purpose is to break down large dye particles or agglomerates of dye particles into smaller ones and thus facilitate their penetration into the textile material and absorption there by the individual fibers; these agents are also added to printing pastes for the same purpose. When present in a rinsing liquor the dye-dispersing agent assists the removal of any dye which remains loosely adhering on the outside of the colored fibers.

Dye-Carriers—In all dyeing and printing processes, apart from those in which insoluble pigments instead of dyes are applied to the textile material, it is generally desirable that the applied dyes should penetrate the fibers to the maximum degree - dye left on the surface of the fibers is easily removed by washing and even by simple rubbing so that it can stain adjacent white materials. Furthermore, a dye which is fixed well inside a textile fiber is generally faster to light than a dye simply attached to the outside.

With hydrophilic fibers such as cotton, wool, etc., the wet swelling that occurs when these fibers come into contact with the aqueous dye liquor much assists dye penetration by ensuring that the fiber substance has increased porosity. But hydrophobic fibers such as nylon, Terylene, Orlon and even acetate fibers absorb very little water when wetted and so do not swell sufficiently to facilitate easy penetration by the dyes commonly applied to these fabrics. It is thus found that deep colorings are not obtained on such fibers unless some substance other than water is present to make the fibers sufficiently dye receptive. Thus has arisen the practice of applying with the dye a small proportion of a substance, generally termed a "dye-carrier" which has the power of swelling the fibers. Dye-carriers are generally organic substances and acetic and lactic acids, phenol, ethyl alcohol, benzoic acid, para- and ortho-phenyl phenol, tripropyl phosphate and similar substances have proved useful. This expedient has proved exceptionally useful in aiding dye absorption and fixation in the dyeing and printing of all the hydrophobic fibers such as acetate, nylon, Terylene, Orlon, Acrilan, Courtelle, etc. Thus a dye-carrier assists dye penetration of the fibers either by swelling the fibers to make them more porous or by dispersing the dye into smaller particles. Furthermore, the use of a dye-carrier allows the dyeing process to be carried out at lower temperatures and completed in a shorter time than without the use of such compounds.

After dyeing with the aid of a dye-carrier it is important to remove this completely from the dyed fibers by thorough washing. Residual dye-carrier can in some instances lower the light-fastness of some dyes, and it can also weaken the fibers or discolor them.

Fiber-Swelling Agents—These substances are also added (as dye-carriers) to dye liquors and also to printing pastes to assist dye penetration and absorption. Care must be taken not to employ them in too high a proportion or concentration otherwise the fibers may suffer serious weakening.

Metal-Sequestering Agents—The water used for dye liquors is liable to be contaminated with metal impurities such as those of iron, manganese, copper, etc., and when this is the case, there is always the risk that the metal will combine with the dye absorbed by the textile material and change its shade (usually the shade is thereby dulled) and possibly lower its fastness to light and other adverse influences. To avoid this defect it is better to purify the water used, but where this is impossible for cost or other reasons it is often convenient to add to the dye liquor a small proportion of a metal-sequestering agent which has the power to combine with the metal and render it inactive towards the dyes used. Among the more important metal-sequestering substances are polyphosphates and ethylene diamine tetra-acetic acid.

Anti-Foaming Agents—Many wetting agents cause excessive foaming of the processing liquors to which they are added and this foaming can be a real nuisance. Thus, special auxiliaries have been introduced having the power to prevent or reduce this foaming without at the same time reducing the wetting effect. Selected silicones are useful anti-foaming agents.

Oil-Emulsifying Agents—These have the power to emulsify fats, oils and waxes so as to give stable emulsions in water which can be used in the finishing of textile materials. Such agents can also be added to scouring liquors for the purpose of assisting the removal of oily or greasy impurities from fabrics and ensuring that these become evenly dispersed in the scouring liquor so as not to become deposited once more on the fabric during the scouring operation.

Moth-Proofing Agents—These products applied to the textile material during finishing make the wool repellent to the moth larvae or act as a poison to them.

Bactericidal Agents—These are applied to counteract odor formation from perspiration in fabrics and garments. They are also used to prevent mildew and fermentation in some finishing compositions.

Anti-Static Agents—These substances are often used on synthetic fiber yarns to give them increased electrical conductivity and so counterbalance their natural tendency to accumulate excessive amounts of static electricity during winding, weaving and knitting operations. It is usual to combine the anti-static agent, which generally has hydrophilic properties, with a fiber-lubricating substance to promote the free movement of the fibers in the yarn. Some agents confer permanent and others only temporary anti-static properties. Synthetic fiber manufacturers can add an anti-static agent to the fiber-forming polymer before fiber spinning. Anti-static agents are available for spraying (in solution) carpets.

Dye-Fixing Agents—Several of these products are now available and they are proving very useful. They are applied to colored textile materials (often in the final rinsing liquor) to make the colors faster to washing. Many of these products are effective because they combine with the dye to form less soluble compounds. Recently introduced agents can chemically link dyes with fibers and thus be more permanently effective.

Anti-Slip Agents—These are usually resinous substances which are applied to rayon and synthetic fiber fabrics of such loose construction that their very smooth threads easily slip over each other to cause fraying. The small proportion of the anti-slip agent which covers the surface of each fiber gives just that degree of roughness and fiber-adhesion which is sufficient to prevent thread slippage.

Rot-Proofing Agents—Fabrics which are exposed to prolonged damp conditions or are left for prolonged periods in contact with the earth deteriorate due to the action of bacteria and various types of micro-organisms. Rot-proofing agents based mainly on copper (sometimes mercury) compounds are applied to counteract this. Synthetic resins can be used as rot-proofing agents.

U.S. Pat. No. 3,989,816 and British Pat. No. 1,553,309 disclose the compounds claimed herein as well as their methods of manufacture, which methods are hereby incorporated by this reference. The compounds are disclosed as useful in enhancing the penetration of the skin of humans and animals of a wide variety of therapeutic and other physiologically active agents; however, there is no disclosure regarding the usefulness of these compounds as textile auxiliaries.

SUMMARY OF THE INVENTION

I have now discovered an improved method of dyeing fibers and especially synthetic fibers by utilizing in the dyeing process, an effective amount of a textile auxiliary having the structural formula

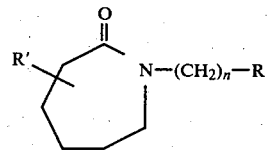

wherein R' is H or a lower alkyl group having 1–4 carbon atoms, n is O or a positive integer from 1–11 and R is an alkyl group (straight or branch chain) having 1–18 carbon atoms or aryl group.

In one preferred embodiment, R' is H, R is $—CH_3$ or $—C_6H_5$ and n is 0–11.

The preferred compound is one in which R' is H, R is $—CH_3$ and n is a straight chain alkyl group of 11 carbon atoms, namely 1-n-dodecylazacycloheptan-2-one.

DETAILED DESCRIPTION OF THE INVENTION

The chief natural fibers now in use are cotton, linen, wool and silk and others such as kapok, hemp, jute and ramie. Man-made fibers include rayon (fibers composed of regenerated cellulose), acetate (fibers composed of cellulose approximately di- or tri-acetate) and synthetic fibers which are composed of non-natural fiber-forming substances manufactured by chemical methods, such as polyamide, acrylic, polyester and polyolefin.

Typical polyamide fibers include nylons such as, for example, poly(hexamethylene-adipamide), poly(m-xylylene adipamide), poly(xylylene sebacamide), polycaprolactom and the like. Typical acrylic fibers are synthetic fibers consisting wholly of polyacrylonitrile or a copolymer of a mixture of acrylonitrile and another vinyl compound, such as Orlon, Dynel, Verel, Creslan, Acrilan, Courtelle and Vinyon. Typical polyester fibers include Terylene, Dacron and Kodel. Typical polyolefin fibers include polyethylene, polypropylene, Vinylon, Rhouyl, Zefran and Darvan.

Various dyestuffs are available and may be classified as substantive or direct dyes, azoic or naphthol dyes, vat dyes and sulfur dyes, acid dyes and mordant or metalized dyes, basic or cationic dyes, disperse dyes and fiber reactive dyes.

Direct dyes are soluble in water and are applied primarily to cellulosic fibers and occasionally to protein fibers and polyamides, azoic or naphthol dyes are somewhat similar to developed direct dyes and are used on the same fiber group. Acid dyes and mordant or metalized dyes are used in protein fibers, acrylic fibers, nylon fibers and some modified polyester fibers. Cationic or basic dyes are used especially for coloring acrylic fibers and may be useful with nylon and polyester fibers. Disperse dyes were orginally developed for use on acetate fibers and are now used for coloring acetate, polyester, acrylic and polyamide fibers. Reactive dyes are used primarily on cotton, cellulosis, wool, silk and acrylics.

While it is usual to dye most natural fibers in dye liquors at temperatures up to 100° C., these conditions are generally not sufficient to allow the production of deep shades on synthetic fiber materials. Furthermore, while some natural fibers, such as wool, can be satisfactorily dyed in boiling aqueous dye liquors, it usually takes 1½ to 2 hours for the dye to be fully absorbed to produce a deep shade. Wool dyes more slowly than cotton and viscose rayon. For this reason, it is generally not practical to dye wool fabrics by conventional continuous dyeing methods. However, at temperatures above 100° C., wool and synthetic fibers absorb dyes more quickly and thus the continuous dyeing of wool would be possible, except that such high temperature dyeing conditions can result in deterioration of the fiber.

With the use of the compounds described herein, the dyeing process can often be carried out at lower temperatures and completed in a shorter time than without the use of such compounds. Furthermore, use of the compounds described herein enhance the penetration of the dyes into the fiber being dyed and improve fastness. The compounds described herein are especially useful in the dyeing of synthetic fibers for carpet.

The amount of the compounds described herein which may be used in the present invention varies with the desired fiber and dye, the desired time and temperature of dyeing and the dyeing process that is used. Generally, the compounds described herein may be used in amounts of about 0.1 to about 50% by weight and preferably about 1 to about 10% by weight of the dye liquor.

The textile materials with which the compounds of the present invention may be used may be of any type including, but not limited to, a yarn or fabric of any of the known fabric types including woven, knitted or non-woven. An especially suitable fabric is a tufted or looped pile carpet.

As used herein, the term "effective amount" in reference to the textile auxiliary disclosed herein has reference to that amount of the disclosed compound sufficient to improve dye penetration by swelling the fibers to be dyed or dispersing the dye being used in the dyeing process into smaller particles or improving dye fastness, or facilitating the use of lower temperatures and shorter times in the dyeing process.

I claim:

1. A method of enhancing dye penetration of fibers by utilizing in the dyeing process, an effective, dye-enhancing amount of 1-n-dodecylazacycloheptan-2-one.

2. The method of claim 1 wherein the fibers are selected from the group of natural and synthetic fibers.

3. The method of claim 1 wherein the fibers are synthetic fibers selected from the group consisting of rayon, acetate, polyamide, acrylic, polyester and polyolefin fibers.

* * * * *